US008459220B2

(12) United States Patent
Comello

(10) Patent No.: US 8,459,220 B2
(45) Date of Patent: Jun. 11, 2013

(54) CONCENTRIC PHASER CAMSHAFT AND A METHOD OF MANUFACTURE THEREOF

(75) Inventor: Paolo J. Comello, Brampton (CA)

(73) Assignee: Magna Powertrain Inc., Concord (CA)

( * ) Notice: Subject to any disclaimer, the term of this patent is extended or adjusted under 35 U.S.C. 154(b) by 526 days.

(21) Appl. No.: 12/738,204

(22) PCT Filed: Oct. 14, 2008

(86) PCT No.: PCT/CA2008/001776

§ 371 (c)(1),
(2), (4) Date: Oct. 15, 2010

(87) PCT Pub. No.: WO2009/049402

PCT Pub. Date: Apr. 23, 2009

(65) Prior Publication Data

US 2011/0023802 A1 Feb. 3, 2011

Related U.S. Application Data

(60) Provisional application No. 60/980,232, filed on Oct. 16, 2007.

(51) Int. Cl.
*F01L 1/34* (2006.01)

(52) U.S. Cl.
USPC ..... 123/90.17; 123/90.15; 123/90.44; 123/90.6; 29/888.1

(58) Field of Classification Search
USPC ..... 123/90.15, 90.17, 90.44, 90.6; 29/888.1
See application file for complete search history.

(56) References Cited

U.S. PATENT DOCUMENTS

| | | | | |
|---|---|---|---|---|
| 3,619,888 | A | 11/1971 | Sawada et al. | |
| 3,999,277 | A | 12/1976 | Hamada | |
| 4,616,389 | A | 10/1986 | Slee | |
| 4,881,680 | A | 11/1989 | Toelke et al. | |
| 5,085,099 | A | 2/1992 | Hughes | |
| 5,201,246 | A | 4/1993 | Arnold et al. | |
| 5,235,939 | A | 8/1993 | Levin et al. | |
| 5,437,097 | A | 8/1995 | Yanagawa | |
| 5,729,899 | A | 3/1998 | Kaywood et al. | |
| 5,937,812 | A | 8/1999 | Reedy et al. | |
| 6,182,361 | B1 | 2/2001 | Cox et al. | |
| 7,287,499 | B2 | 10/2007 | Lawrence et al. | |
| 7,610,890 | B2 * | 11/2009 | Lettmann et al. | 123/90.6 |

FOREIGN PATENT DOCUMENTS

| | | |
|---|---|---|
| CA | 1326962 | 2/1994 |
| DE | 3206791 | 11/1983 |
| JP | 60190501 | 9/1985 |
| JP | 62097722 | 5/1987 |
| WO | 2006081788 A1 | 8/2006 |
| WO | 2007076797 A1 | 7/2007 |

* cited by examiner

*Primary Examiner* — Ching Chang
(74) *Attorney, Agent, or Firm* — Magna International Inc.

(57) ABSTRACT

A novel concentric phaser camshaft comprises valve actuating lobes that are arranged into lobe structures. The valve actuating lobes to be affixed to an inner camshaft member, are arranged in pinned structures comprising adjacent pairs of lobes which are affixed to the inner camshaft member by pins. The valve actuating lobes to be affixed to the outer camshaft member by an interference fit are arranged into lobe structures comprising a bearing journal and at least one lobe, each lobe structure including an index feature operable to engage a jig to angularly position the lobe structure on the outer camshaft member while the interference fit is established.

4 Claims, 6 Drawing Sheets

CONCENTRIC PHASER CAMSHAFT AND A METHOD OF MANUFACTURE THEREOF

CROSS-REFERENCE TO RELATED APPLICATIONS

This application is a national phase application and claims the benefit, under 35 U.S.C. §371, of PCT/CA 2008/001776, filed on Oct. 14, 2008, which in turn claims the priority of U.S. Provisional Application No. 60/980,232, filed on Oct. 16, 2007. All applications are incorporated herein by reference in their entireties.

FIELD OF THE INVENTION

The present invention relates to a camshaft for internal combustion engines. More specifically, the present invention relates to a concentric phaser camshaft, and a method of manufacturing the camshaft, which provides for alteration of the valve timing in an internal combustion engine.

BACKGROUND OF THE INVENTION

To increase engine operating efficiencies and reduce unwanted emissions, it is known to alter the timing of the opening and closing of inlet and/or exhaust valves for internal combustion engines depending upon the engine operating conditions. As is well known, the optimal valve opening and closing, relative to the position of the engine crankshaft, for an internal combustion engine is dependent upon the engine operating speed, and to a lesser extent, other factors such as the engine load.

Ideally, the timing with which the inlet valves are opened and closed with respect to the crankshaft position should be changed independently of the timing with which the exhaust valves are opened and closed with respect to the crankshaft position. This change in the relative timing between the inlet and exhaust valves is typically referred to as the valve timing phasing.

In engines wherein one camshaft operates the inlet valves and a second camshaft operates the exhaust valves, the valve timing is adjusted by altering the position of each camshaft with respect to the synchronous drive (typically a toothed belt or chain) driven by the crankshaft and which rotates the camshafts and a variety of technologies and methods for achieving this are well known to those of skill in the art.

Until recently, it has not been possible to alter the valve timing in engines which employ a single camshaft to operate both inlet and exhaust valves, such as SOHC engines or engines employing push rods. However, recent development of concentric phaser camshafts, such as those described in U.S. Pat. No. 5,664,462 to Amborn et al., published international patent application WO 2006/097767 to Methley et al. and/or the SCP camshafts developed and sold by Mechadyne International Limited, Park Farm Technology Centre, Kirtlington, Okfordshire, UK now allow the alteration of valve timing in such engines.

These concentric phaser camshafts comprise a dual-acting camshaft wherein one of the set of inlet valve actuating cam lobes or the set of exhaust valve actuating cam lobes are fixed to a tubular outer camshaft member, while the other of the sets of inlet valve actuating cam lobes or exhaust valve actuating cam lobes are fixed to an inner camshaft member, mounted inside the outer camshaft member, and which is capable of relative rotation thereto.

While such camshafts provide obvious advantages and benefits, their manufacture is complex and/or expensive to achieve. Generally, the inner camshaft member is inserted into the outer camshaft member and an alternating stack of exhaust and inlet actuating lobes is mounted to the assembly of the inner and outer camshaft members.

The lobes affixed to the inner member are typically mechanically affixed to the inner camshaft member by pins inserted through bores in the lobe, then through corresponding slots in the outer camshaft member and finally into a corresponding bore in the inner camshaft member. The lobes which are affixed to the outer camshaft member are typically affixed by an interference fit wherein the lobe is heated to expand it and the assembly of the inner and outer camshaft members is cooled, via liquid nitrogen or the like, to allow the lobe to be positioned onto the outer camshaft member. Once appropriately placed, the lobe cools and the camshaft assembly warms providing an interference fit between the outer camshaft member and the lobe to fix the lobe in place.

While this assembly technique has been employed to date, it is expensive and time consuming to achieve. Generally, the tolerances for the rotational positioning of the lobes are generally one-half degree, or less. While it is relatively easy to create the bores through the inner camshaft member and the bores through the cam lobes to be affixed to it to correctly rotationally position those lobes on the camshaft, it is much more difficult to correctly rotationally position the lobes on the outer camshaft member while the interference fit between them is established.

SUMMARY OF THE INVENTION

It is an object of the present invention to provide a novel concentric phaser camshaft which obviates or mitigates at least one disadvantage of the prior art.

According to a first aspect of the present invention, there is provided a concentric phaser camshaft, comprising: an outer camshaft member; an inner camshaft member being rotatably mounted within the outer camshaft member; at least one pinned lobe structure comprising a pair of valve actuating lobes, each valve actuating lobe being at a selected angular position with respect to a bore through the pinned lobe structure, the selected angular position for a first valve actuating lobe of the pair differing from the selected angular position for the other valve actuating lobe of the pair and wherein the pinned lobe structure is affixed to the inner camshaft member by a pin extending through the bore and into the inner camshaft member, the pin extending through a slot in the outer camshaft member such that the pinned lobe structure rotates with the inner camshaft member relative to the outer camshaft member; and at least on lobe structure comprising a bearing journal, at least one valve actuating lobe and an index feature, the index feature indicating a pre-selected angular position for the valve actuating lobe and the index feature assisting in angularly locating the lobe structure with respect to the outer camshaft member while the lobe structure is affixed to the outer camshaft stricture by an interference fit.

Preferably, a positioning jig engages the outer camshaft member and the index feature on each of the at least one lobe structures to angularly position the valve actuating lobes of the at least one lobe structures prior to the establishment of the interference fit.

The present invention provides a novel concentric phaser camshaft whose lobes are arranged into lobe structures. The valve actuating lobes to be affixed to an inner camshaft member are arranged in pinned structures comprising adjacent pairs of lobes which are affixed to the inner camshaft member by pins. The valve actuating lobes to be affixed to the outer camshaft member by an interference fit are arranged into lobe structures comprising a bearing journal and at least one lobe, each lobe structure including an index feature operable to engage a jig to angularly position the lobe structure on the outer camshaft member while the interference fit is established.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
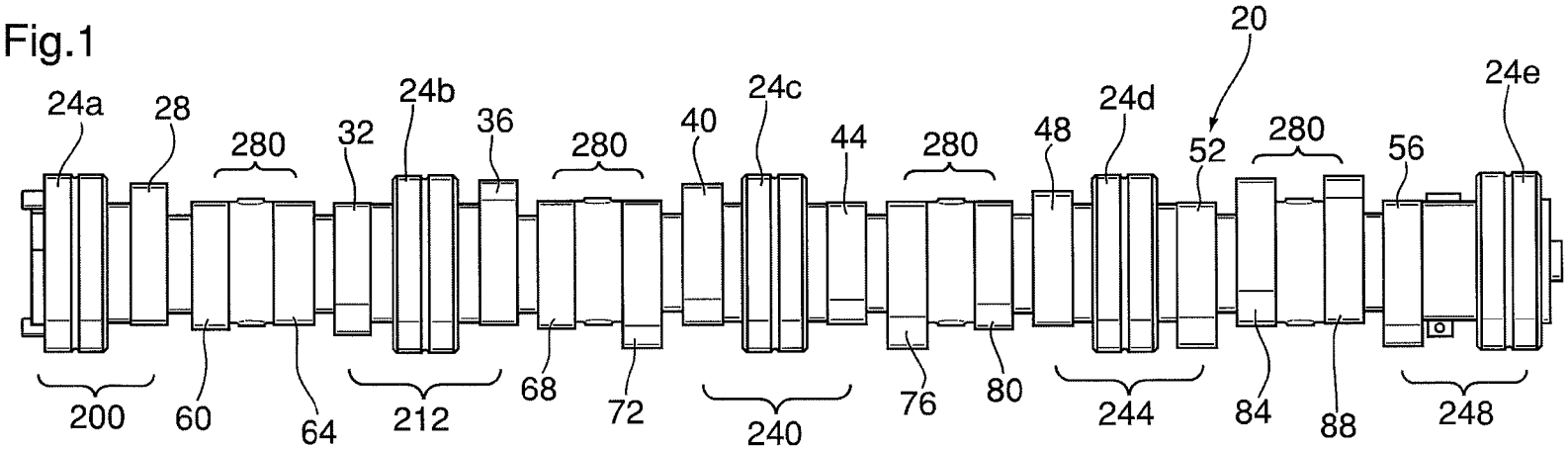
FIG. 1 shows a side view of a concentric phaser camshaft in accordance with the present invention.
Figure 2:
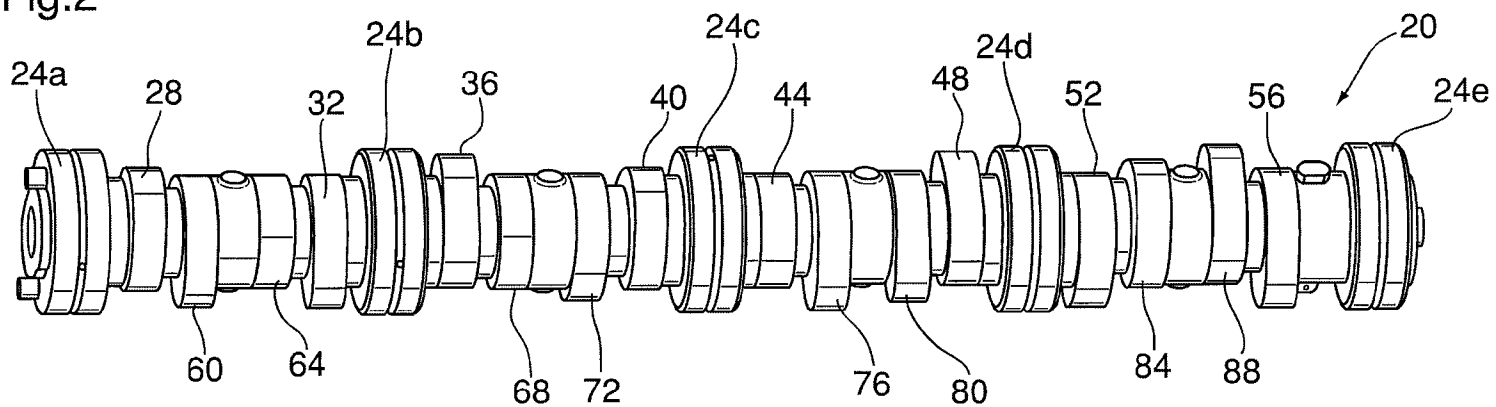
FIG. 2 shows a perspective view of the camshaft of FIG. 1.

A concentric camshaft in accordance with the present invention is indicated generally at 20 in FIGS. 1 and 2. Camshaft 20 comprises a set of bearing journals 24 which are used to rotatably mount camshaft 20 into an engine (not shown). Bearing journals 24 can be received in babbitt bearings or any other suitable bearing as well occur to those of skill in the art.

In the particular embodiment of the present invention illustrated in the Figures, camshaft 20 is intended for use in a V8 engine and camshaft 20 includes: eight lobes (28, 32, 36, 40, 44, 48, 52 and 56) for the actuation of inlet valves; eight lobes (60, 64, 68, 72, 76, 80, 84 and 88) for the actuation of exhaust valves; and five bearing journals (24*a*, 24*b*, 24*c*, 24*d* and 24*e*).

As will be apparent to those of skill in the art, the present invention is not limited to use with camshafts for V8 engines, nor to camshafts with two valves per cylinder and can, instead, be used with camshafts for a wide range of engine styles and/or designs.

Figure 3:
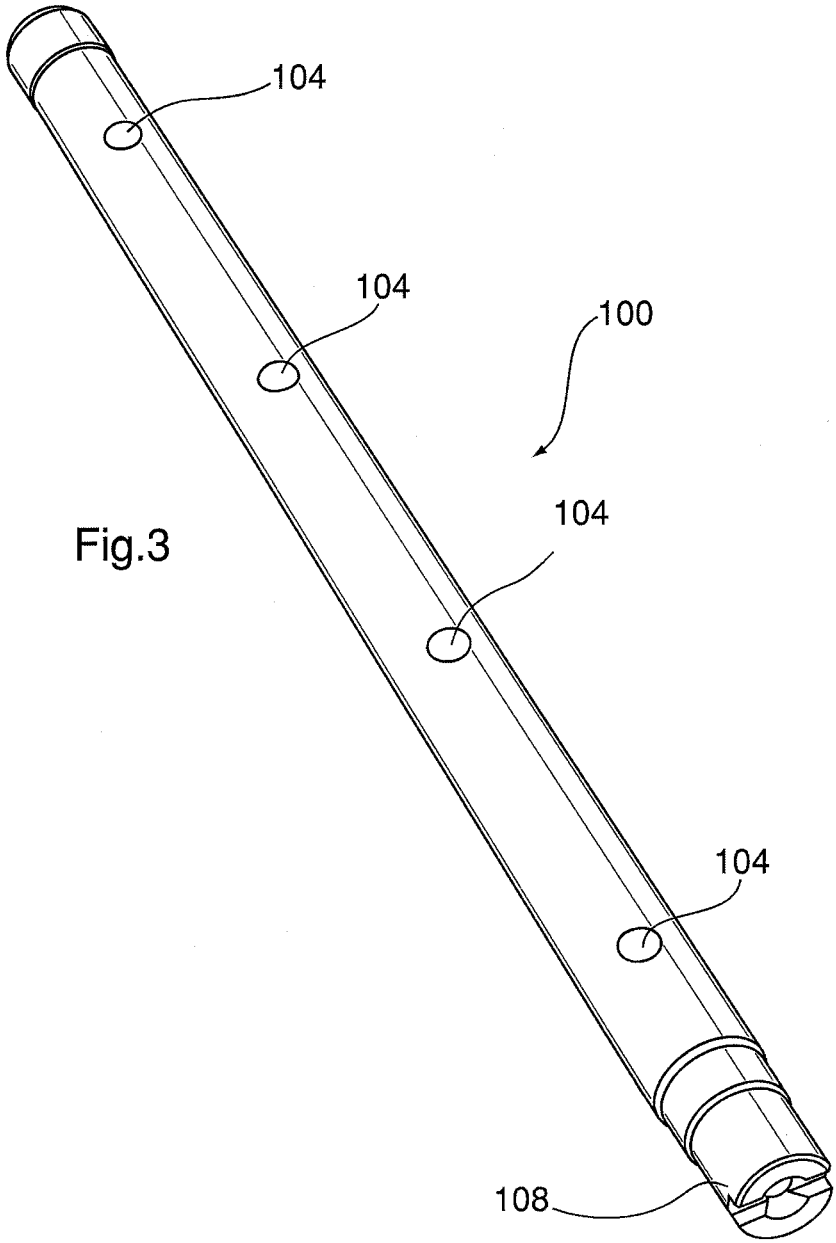
FIG. 3 shows a perspective view of an inner camshaft member of the camshaft of FIG. 1.

FIG. 3 shows inner camshaft member 100 of camshaft 20. As shown, inner camshaft member 100 includes a set of bores 104 to receive locking pins to affix the exhaust valve actuation lobes (60, 64, 68, 72, 76, 80, 84 and 88) to rotate with inner camshaft member 100 as described below. Inner camshaft member 100 further includes a driven structure 108 which engages the cam phasing unit that connects camshaft 20 to the synchronous drive rotating it.

While in this discussion the exhaust valve actuating lobes (60, 64, 68, 72, 76, 80, 84 and 88) are affixed to inner camshaft member 100, the present invention is not so limited and, if desired, the inlet valve lobes (28, 32, 36, 40, 44, 48, 52 and 56) can be affixed to inner camshaft member 100 while the exhaust valve actuating lobes (60, 64, 68, 72, 76, 80, 84 and 88) are affixed to outer camshaft member 120.

Figure 4:
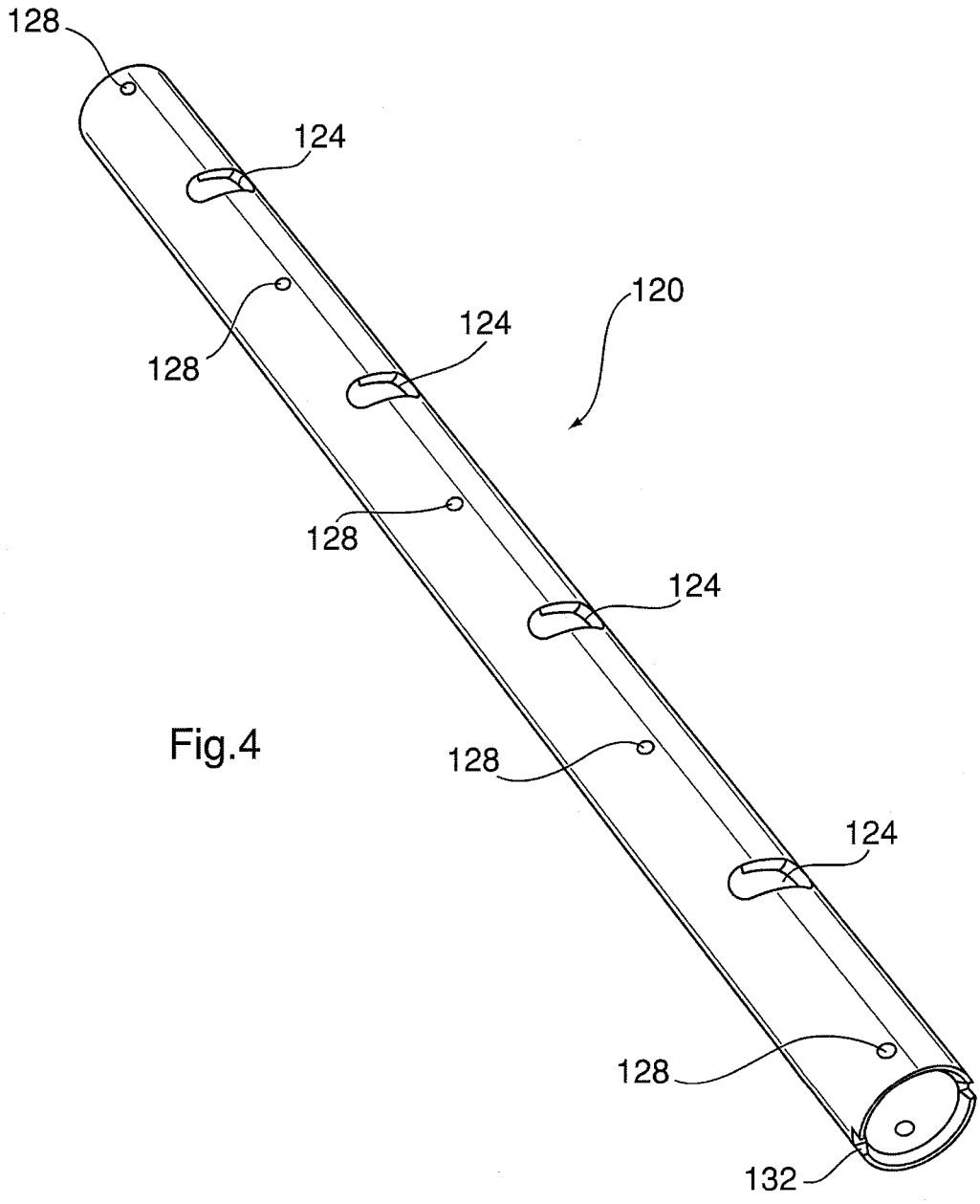
FIG. 4 shows a perspective view of an outer camshaft member of the camshaft of FIG. 1.

FIG. 4 shows outer camshaft member 120 of camshaft 20. As shown, outer camshaft member 120 includes a set of slots 124, corresponding to bores 104 in inner camshaft member 100. Outer camshaft member 120 further includes a set of oil passages 128, further described below, and a drive structure 132 which engages the cam phasing unit that connects camshaft 20 to the synchronous drive rotating it.

Figure 5:
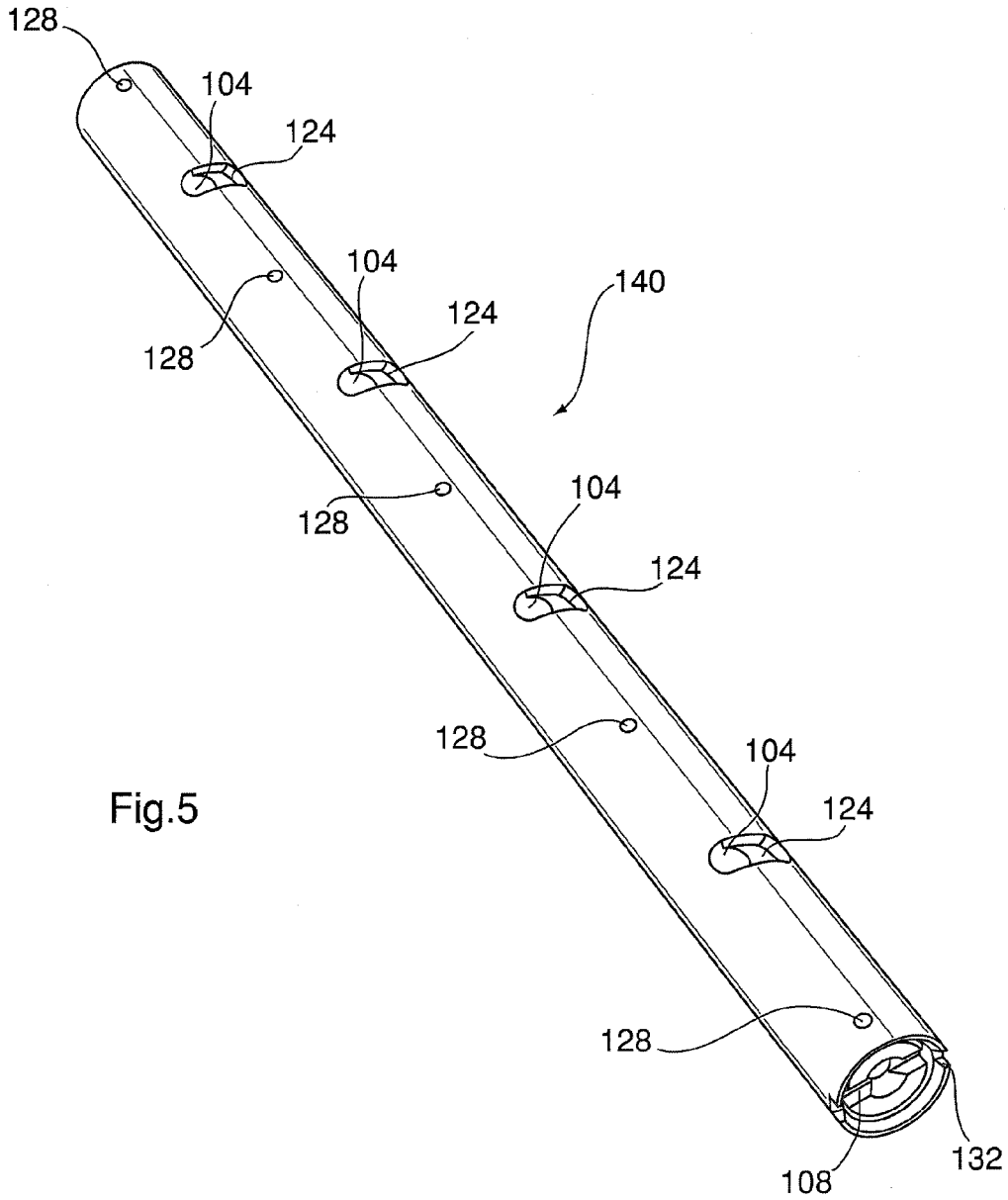
FIG. 5 shows a perspective view of the assembly of the outer camshaft member of FIG. 4 and the inner camshaft member of FIG. 3.

FIG. 5 shows the assembly 140 of inner camshaft member 100 and outer camshaft member 120, before any inlet or exhaust cam lobes or bearing journals are installed. Inner camshaft member 100 can be fabricated with bearing surfaces to permit inner camshaft member 100 to rotate with respect to outer camshaft member 120, or appropriate bearings can be inserted between inner camshaft member 100 and outer camshaft member 120 as assembly 140 is formed.

Figure 6:
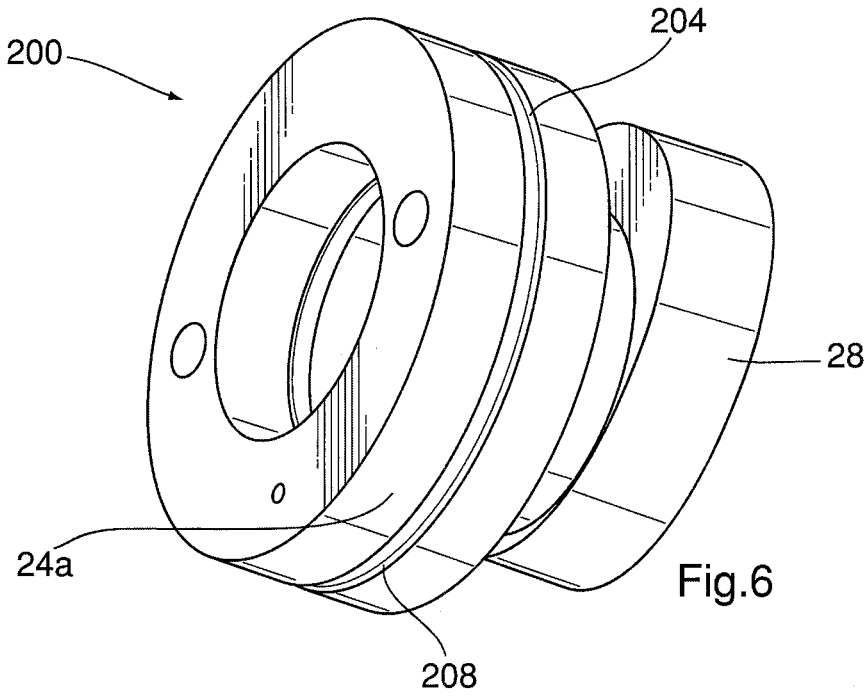
FIG. 6 shows a perspective view of a lobe structure of the camshaft of FIG. 1 including a single valve actuating lobe.

Instead of individually positioned lobes for the lobes affixed to outer camshaft member 120, as used in the prior art, the present invention employs lobe structures comprising a bearing journal and lobe or a bearing journal and a pair of lobes. FIG. 6 shows a lobe structure 200, used at the end of assembly 140. As shown, the illustrated lobe structure 200 includes bearing journal 24*a* and lobe 28. As is also shown, bearing journal 24*a* includes an oil way 204 to provide lubricating oil to the bearing (not shown) in which bearing journal 24*a* will ride. A radial oil passage 208 is formed through journal bearing 24*a* from oil way 204 to the interior of bearing journal 24*a* and, when journal bearing 24*a* is properly mounted to outer camshaft member 120, oil passage 208 will be in fluid communication with the corresponding one of oil passages 128.

Figure 7:
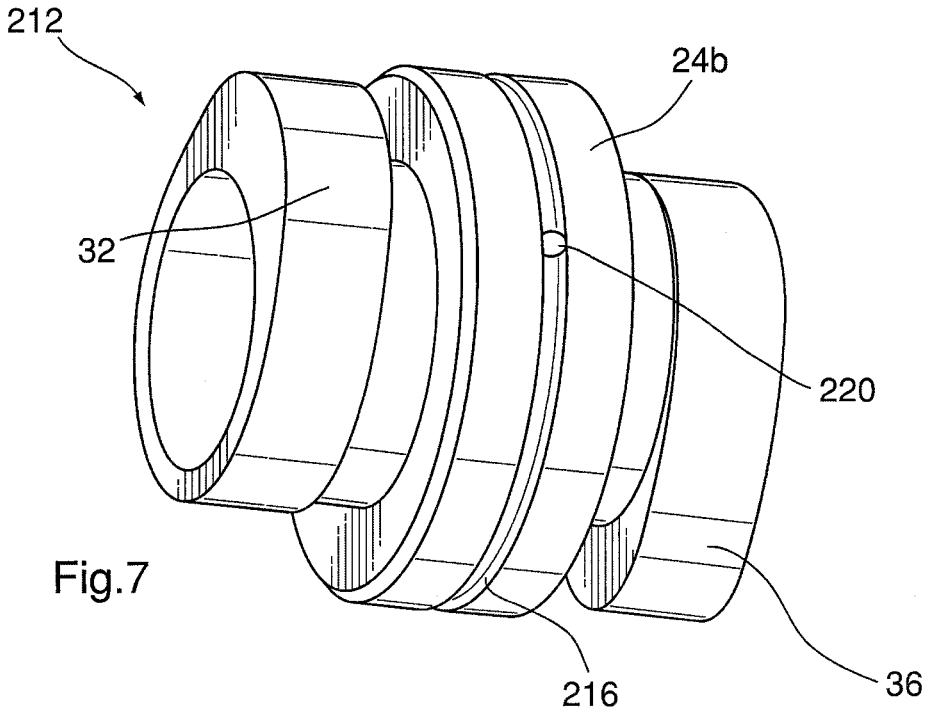
FIG. 7 shows a perspective view of a lobe structure of the camshaft of FIG. 1 including a pair of valve actuating lobes.

FIG. 7 shows a lobe structure 212 used at a first intermediate position along assembly 140. As shown, illustrated lobe structure 212 includes a bearing journal 24*b* and lobes 32 and 36. As is also shown, bearing journal 24*b* includes an oil way 216 to provide lubricating oil to the bearing (not shown) in which bearing journal 24*b* will ride. A radial oil passage 220 is formed through journal bearing 24*b* from oil way 216 to the interior of bearing journal 24*b* and, when journal bearing 24*b* is properly mounted to outer camshaft member 120, oil passage 220 will be in fluid communication with the corresponding one of oil passages 128. The relative angular positioning of lobes 32 and 36 within lobe structure 212 is determined by the requirements of the engine design and configuration.

Lobe structures 200, 212, 240, 244 and 248 can be fabricated in any suitable manner as will occur to those of skill in the art and in a present embodiment these lobe structures are formed through a pressed metal process with appropriate polishing and finishing, as required. However any other suitable manufacturing technique, including forging, machining from a blank, etc. can be employed if desired.

Lobe structures 240 and 244 can be very similar to lobe structure 212, except for the relative angular positioning of their respective lobes, and each include an oil way and oil passage. Unless necessitated by other factors, such as factors relating to the mounting or driving of camshaft 20, lobe structure 248 can be similar, or identical, to lobe structure 200 and also includes an oil way and oil passage.

As mentioned above, the tolerance for the rotational positioning of lobes on camshaft 20 is typically a half degree or less and that such precision can be difficult to obtain for the lobes affixed to outer camshaft member 120 by an interference fit. With the present invention, to ensure accurate positioning of these lobes (in the illustrated embodiment, lobes 28, 32, 36, 40, 44, 48, 52 and 56 of lobe structures 200, 212, 240, 244 and 248), an index feature is provided on each lobe structure 200, 212, 240, 244 and 248 and this index feature provides for the accurate rotational positioning of lobe structures 200, 212, 240, 244 and 248 and their respective lobes.

In a present embodiment of the invention, the oil passage connecting the oil way to the interior of the lobe structure also functions as this index feature. For example, oil passage 208 of lobe structure 200 is formed at a pre-specified angular position with respect to the angular position of lobe 28. When lobe structure 200 is assembled onto camshaft structure 140, a locating jig engages oil passage 208 to ensure that lobe structure 200 is in the specified angular position with respect to camshaft structure 140.

Similarly, oil passage 220 of lobe structure 212 is formed at a pre-specified angular position with respect to the angular positions of lobes 32 and 36 and a locating jig will engage oil passage 220 to ensure the desired rotational positioning of lobes 32 and 36 is obtained when lobe structure 212 is assembled to camshaft structure 140.

As will now be apparent to those of skill in the art, the oil passage of each of lobe structures 200, 212, 240, 244 and 248 is angularly positioned to act as an index feature to allow accurate angular positioning of their respective lobes on camshaft structure 140.

While in the illustrated embodiment of the invention, the oil passages of lobes structures 200, 212, 240, 244 and 248 serve as the index feature, the present invention is not limited to the use of these oil passages as the index feature and it is contemplated that other suitable features, such as bosses, detents, flats, etc. can be employed as index features if desired.

Figure 8:
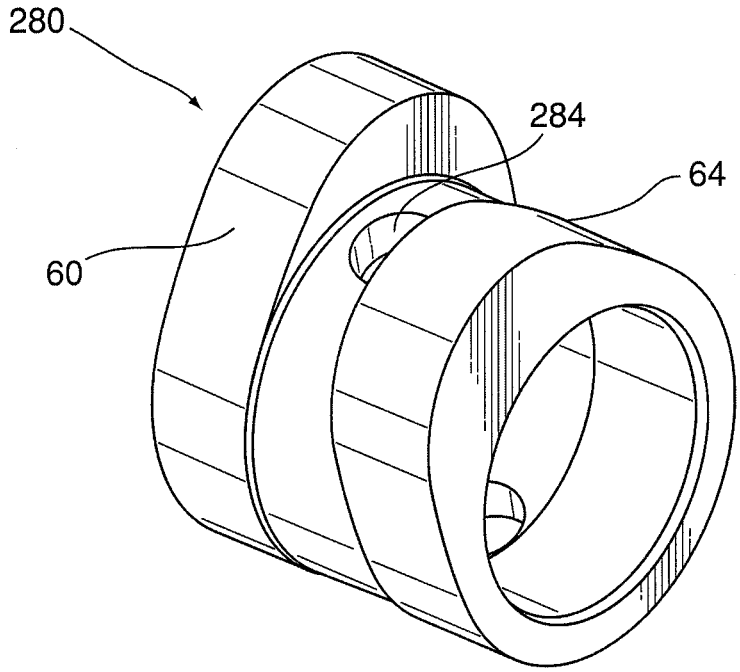
FIG. 8 shows a perspective view of a pinned lobe structure of the camshaft of FIG. 1.

With camshaft 20, the lobes to be affixed to inner camshaft member 100 are arranged in pinned lobe structures 280, an example of which is shown in FIG. 8. The particular pinned lobe structure 280 shown in FIG. 8 comprises lobes 60 and 64, but as will be apparent to those of skill in the art, other pinned lobes structures 280 of the present invention will comprise other lobes. Further, depending upon the design of the engine in which camshaft 20 is to be installed, each of pinned lobe structures 280 can be unique, in that the angular rotational positioning of the pair of lobes making up the structure 280 can differ. Each pinned lobe structure 280 includes a pin bore 284 through which the affixing pin (not shown) can be inserted to affix pinned lobe structure 280 to inner camshaft member 100.

To assemble camshaft 20, outer camshaft member 120 is cooled to a temperature appropriate to effect a pre-selected amount of thermal contraction of the radius of outer camshaft member 120. In a present embodiment of the invention, this cooling is effected with liquid nitrogen, however any suitable manner of cooling can be employed as will occur to those of skill in the art.

At the same time, lobe structures 200, 212, 240, 244 and 248 are heated to a temperature to effect a pre-selected amount of thermal expansion of their center (open) radius. In a present embodiment of the invention, this heating is effected by inductive heating, however any suitable manner of heating can be employed as will occur to those of skill in the art.

Assembly proceeds by alternating placing the appropriate a lobe structures (200, 212, 240, 244 and 248) and pinned lobe structures 280 onto outer camshaft member 120.

An alignment jig (not shown) is then angularly located with respect to drive structure 132 of outer camshaft member 120 and lobe structures 200, 212, 240, 244 and 248 are angularly positioned on outer camshaft member 120 such that their respective index features engage corresponding features on the alignment jig, thus ensuring that lobe structures 200, 212, 240, 244 and 248 are correctly angularly positioned. Outer camshaft member 120 and the stack of lobe structures and pinned lobes structures is then allowed to temperature equalize such that lobe structures 200, 212, 240, 244 and 248 are affixed in place by an interference fit.

Next, the alignment jig is removed and inner camshaft member 100 is inserted into outer camshaft member 120. Then, each pinned lobe structure 280 is angularly positioned such that its respective pin bore 284 is aligned with a respective slot 124 in outer camshaft member 120 and with a respective bore 104 in inner camshaft member 100 and a pin is then pressed into place in each pinned lobe structure 280 to affix each pinned lobe structure 280 in place in the required angular position. As will be apparent to those of skill in the art, while in the present embodiment of the invention it is preferred to use pins to affix pinned lobe structures 280, the present invention is not so limited and any other suitable means, as will occur to those of skill in the art, can be employed to affixed pinned lobe structures 280 to inner camshaft member 100.

The present invention provides a novel concentric phaser camshaft whose lobes are arranged into lobe structures. The valve actuating lobes to be affixed to an inner camshaft member, are arranged in pinned structures comprising adjacent pairs of lobes which are affixed to the inner camshaft member by pins. The valve actuating lobes to be affixed to the outer camshaft member by an interference fit are arranged into lobe structures comprising a bearing journal and at least one lobe, each lobe structure including an index feature operable to engage a jig to angularly position the lobe structure on the outer camshaft member while the interference fit is established.

The above-described embodiments of the invention are intended to be examples of the present invention and alterations and modifications may be effected thereto, by those of skill in the art, without departing from the scope of the invention which is defined solely by the claims appended hereto.

I claim:

1. A concentric phaser camshaft, comprising:

an outer camshaft member;

an inner camshaft member being rotatably mounted within the outer camshaft member;

at least one pinned lobe structure comprising a pair of valve actuating lobes, each valve actuating lobe being at a selected angular position with respect to a bore through the pinned lobe structure, the selected angular position for a first valve actuating lobe of the pair differing from the selected angular position for the other valve actuating lobe of the pair and wherein the pinned lobe structure is affixed to the inner camshaft member by a pin extending through the bore and into the inner camshaft member, the pin extending through a slot in the outer camshaft member such that the pinned lobe structure rotates with the inner camshaft member relative to the outer camshaft member; and at least on lobe structure comprising a bearing journal, at least one valve actuating lobe and an index feature, the index feature indicating a pre-selected angular position for the at least one valve actuating lobe and the index feature assisting in angularly locating the at least one lobe structure with respect to the outer camshaft member while the lobe structure is affixed to the outer camshaft member by an interference fit.

2. The concentric phaser camshaft of claim 1 wherein a positioning jig engages the outer camshaft member and the index feature on each of the at least one lobe structures to angularly position the valve actuating lobes of the at least one lobe structures prior to the establishment of the interference fit.

3. The concentric phaser camshaft of claim 2 wherein said index feature is an oil passage.

4. The concentric phaser camshaft of claim 1 wherein said index feature is an oil passage.

* * * * *